US009196971B2

(12) United States Patent
Gery et al.

(10) Patent No.: US 9,196,971 B2
(45) Date of Patent: Nov. 24, 2015

(54) ASSEMBLY HAVING A TUBULAR PORTION CRIMPED TO A CABLE AT SEVERAL LOCATIONS WITH VARYING DEGREES OF COMPRESSION

(71) Applicant: MECATRACTION, Arnac Pompadour (FR)

(72) Inventors: Eric Gery, Conceze (FR); Jonathan Brette, Saint-Aulaire (FR); Jerome Jeambrun, Lubersac (FR)

(73) Assignee: MECATRACTION, Arnac (FR)

( * ) Notice: Subject to any disclaimer, the term of this patent is extended or adjusted under 35 U.S.C. 154(b) by 0 days.

(21) Appl. No.: 14/020,950

(22) Filed: Sep. 9, 2013

(65) Prior Publication Data

US 2014/0073205 A1 Mar. 13, 2014

(30) Foreign Application Priority Data

Sep. 7, 2012 (FR) ..... 12 58423

(51) Int. Cl.

| | |
|---|---|
| ***H01R 4/10*** | (2006.01) |
| ***H01R 4/18*** | (2006.01) |
| ***H01R 4/20*** | (2006.01) |
| ***H01R 43/048*** | (2006.01) |
| ***H01R 43/04*** | (2006.01) |
| *H01R 4/62* | (2006.01) |
| *H01R 11/12* | (2006.01) |
| *H01R 43/058* | (2006.01) |

(52) U.S. Cl.

CPC ..... *H01R 4/183* (2013.01); *H01R 4/10* (2013.01); *H01R 4/203* (2013.01); *H01R 43/04* (2013.01); *H01R 43/0482* (2013.01); *H01R 4/62* (2013.01); *H01R 11/12* (2013.01); *H01R 43/0484* (2013.01); *H01R 43/0585* (2013.01); *H01R 2201/26* (2013.01); *Y10T 29/49183* (2015.01)

(58) Field of Classification Search

CPC ..... H01R 4/10–4/206
USPC ..... 439/877–878
See application file for complete search history.

(56) References Cited

U.S. PATENT DOCUMENTS

| | | | | | |
|---|---|---|---|---|---|
| 1,164,100 | A | * | 12/1915 | Stuart-Prince | 84/76 |
| 2,276,140 | A | * | 3/1942 | Andren et al. | 439/877 |
| 2,810,897 | A | * | 10/1957 | Schinske | 174/84 C |
| 3,955,044 | A | * | 5/1976 | Hoffman et al. | 174/84 C |

FOREIGN PATENT DOCUMENTS

| | | |
|---|---|---|
| GB | 1 164 100 | 9/1969 |
| WO | 98/54790 | 12/1998 |

OTHER PUBLICATIONS

French Search Report dated May 13, 2013, corresponding to the Foreign Priority Application No. 1258423.

* cited by examiner

*Primary Examiner* — Chandrika Prasad
(74) *Attorney, Agent, or Firm* — Young & Thompson

(57) ABSTRACT

Disclosed is a method of assembling a connecting device (3) on a stripped end section (6) of an electric cable (4), the method including a first step of crimping a first zone (40) of a tubular portion (13) of the device with a first portion (43) of the section that is configured so that the first portion has a first predetermined degree of compression; a second step of crimping a second zone (41) of the tubular portion with a second portion (44) of the section that is configured so that the second portion has a second predetermined degree of compression lower than the first degree; a step of punching a third zone (42) of the tubular portion with a third portion (56) of the section which is configured so that the third portion has a third predetermined degree of compression higher than the first degree.

12 Claims, 4 Drawing Sheets

ASSEMBLY HAVING A TUBULAR PORTION CRIMPED TO A CABLE AT SEVERAL LOCATIONS WITH VARYING DEGREES OF COMPRESSION

The invention relates to methods of assembling a connecting device on a stripped end section of an electric cable.

The invention also relates to assemblies comprising said connecting device securely assembled on such a stripped end section of an electric cable.

Such a method and such an assembly are already known, in particular from U.S. Pat. No. 3,955,044, comprising a connecting device provided with a portion that is to be crimped or has been crimped on a cable and a flat portion provided for interacting with a screw terminal.

The cable is introduced, at the level of a stripped end section, into the tubular portion of the connecting device and is securely assembled there by crimping of this tubular portion on said stripped end section.

The method of assembling this device on this stripped end section comprises a single crimping step carried out by a crimping device provided with two jaws, namely a lower jaw that is approximately flat and an upper jaw having several steps.

Thus, with a same crimping force applied during a single crimping step carried out by a single pair of jaws, the stripped end section and the tubular portion are crimped together in steps, with the stripped end section having a degree of compression that is variable and gradual between a portion farthest from an insertion opening made in the tubular portion and a portion closest to this opening, but not in the immediate vicinity of the latter.

The invention aims to improve methods of assembling a connecting device on a stripped end section of an electric cable, while still being particularly simple, convenient and economical to implement.

Thus, in a first aspect, the invention relates to a method of assembling a connecting device on a stripped end section of an electric cable, said connecting device comprising a conducting element having a tubular portion and an insertion opening through which it is intended to introduce said stripped end section into said tubular portion, said method comprising the steps of:

- supplying a said connecting device and a said electric cable;
- introducing said stripped end section into said tubular portion via said insertion opening;
- securely assembling said tubular portion on said stripped end section;

said method being characterized in that said step of securely assembling comprises:

- a first step of crimping a first zone of said tubular portion with a first portion of said stripped end section that is located in said first zone, which first zone being farthest from said insertion opening, said first crimping step being configured so that said first crimped portion of said stripped end section has a first predetermined degree of compression;
- a second step of crimping a second zone of said tubular portion with a second portion of said stripped end section that is located in said second zone, which second zone being closest to said insertion opening, said second crimping step being configured so that said second portion of said stripped end section has a second predetermined degree of compression lower than said first predetermined degree of compression;

- a step of punching a third zone of said tubular portion with a third portion of said stripped end section that is located in said third zone, which third zone being between said first and second zones, said punching step being configured so that said third portion of said stripped end section has a third predetermined degree of compression higher than said first predetermined degree of compression.

The crimping of the first zone of the tubular portion on the first portion of the stripped end section, which is carried out with first predetermined crimping parameters, makes it possible to maintain securely this first portion in the connecting device, without being concerned about any flexibility of this first portion relative to the connecting device. In other words, the first portion of the stripped end section is locked in the first zone of the tubular portion and has a first degree of compression, called "medium" here.

The crimping of the second zone of the tubular portion on the second portion of the stripped end section, which is carried out with second predetermined crimping parameters, makes it possible to maintain this second portion in the connecting device, while ensuring a certain flexibility of this second portion relative to the connecting device. In other words, the second portion of the stripped end section is fixed in the second zone of the tubular portion while allowing folding of the electric cable at the level of and in close proximity to this second portion, the latter having a second degree of compression, called "low" here.

The punching of the third zone of the tubular portion on the third portion of the stripped end section, which is carried out with predetermined punching parameters, makes it possible to compact (more than in a crimping operation) the material of the tubular portion forming this third zone together with the material of the electric cable forming the third portion. In other words, the third portion of the stripped end section is compacted with the third zone of the tubular portion and has a third degree of compression, called "strong" here; so as to ensure a permanent electrical contact between the connecting device and the electric cable.

The method according to the invention therefore offers particularly efficient mechanical and electrical fastening between the connecting device and the electric cable thanks to a double crimping, carried out with predetermined crimping parameters that are different, away from and near the insertion opening respectively, combined with a punching, carried out between the two crimped zones and portions using predetermined punching parameters that are distinct from the predetermined crimping parameters.

It should be noted that in this instance, crimping and punching steps for obtaining a different distribution of material of the crimped and punched elements. In fact, it will be assumed that the compactness of a punched zone/portion has a ratio of external perimeter of said zone/portion to the smallest height passing through the centre of gravity (in this instance the geometric centre) of said zone/portion, which is greater than or equal to about 6; whereas the compactness of a crimped zone/portion has a ratio of external perimeter of said zone/portion to the smallest height passing through the centre of gravity of said zone/portion, which is less than about 6.

It should also be noted that the crimping and/or punching parameters are in particular defined by a closing dimension of crimping and/or punching devices and by the shape of impression of such devices. These are the parameters that characterize the degrees of compression obtained, also called degree of reduction of cross-section. These parameters also depend of course on the diameter of the conductive core of the electric cable.

It should further be noted that the method according to the invention offers particularly good performance while remaining particularly simple, convenient and economical to implement.

According to preferred, simple, convenient and economical features of the method of assembly according to the invention:

said first and second crimping steps are carried out at the same time and are followed by said punching step;

said first and second crimping steps and said punching step are carried out at the same time;

said first crimping step is configured so that said first degree of compression is comprised in the range [10%; 30%];

said second crimping step is configured so that said second degree of compression is comprised in the range [2%; 20%]; and/or said punching step is configured so that said third degree of compression is comprised in the range [25%; 45%].

It should be noted that in the case when the first and second crimping steps are carried out at the same time and are followed by the punching step, electrical connection performance are obtained that are far better than performance of punching being carried out alone.

In fact, the first and second crimpings, already carried out when the punching is carried out, maintain the end section of the electric cable longitudinally. Consequently, during punching, the end section of the electric cable cannot deform itself outside of the punching zone, or in any case can only deform itself to a particularly limited extent.

As a result, the end section of the electric cable in the punching zone is submitted to intensive deformation, favourable to the quality of the electrical connection, especially when the electric cable is of aluminium, as the layer of aluminium oxide present on the surface is then fractured particularly effectively.

In a second aspect, the invention also relates to an assembly having a connecting device securely assembled on a stripped end section of an electric cable, said connecting device comprising a conducting element having a tubular portion and an insertion opening through which said stripped end section is introduced into said tubular portion, said assembly being characterized in that said tubular portion comprises a first crimped zone with a first portion of said stripped end section that is located in said first zone, said first zone being farthest from said insertion opening, and with said first portion having a first predetermined degree of compression; said tubular portion further comprises a second crimped zone with a second portion of said stripped end section that is located in said second zone, said second zone being closest to said insertion opening, and with said second portion having a second predetermined degree of compression lower than said first predetermined degree of compression; and said tubular portion further comprises a third punched zone with a third portion of said stripped end section that is located in said third zone, said third zone being between said first and second zones, and with said third portion having a third predetermined degree of compression higher than said first predetermined degree of compression; thanks to which said tubular portion and said stripped end section are crimped and punched together.

The first degree of compression, called "medium" here, of the first portion of the stripped end section is characteristic of the crimping of the first zone of the tubular portion on this first portion, which is carried out with first predetermined crimping parameters, and of keeping this first portion integral in the connecting device, without being concerned about any flexibility of this first portion relative to the connecting device. In other words, the first portion of the stripped end section is locked in the first zone of the tubular portion.

The second degree of compression, called "low" here, of the second portion of the stripped end section is characteristic of the crimping of the second zone of the tubular portion on this second portion, which is carried out with second predetermined crimping parameters, and of holding this second portion in the connecting device, while ensuring a certain flexibility of this second portion relative to the connecting device. In other words, the second portion of the stripped end section is fixed in the second zone of the tubular portion while allowing folding of the electric cable at the level of and in close proximity to this second portion.

The third degree of compression, called "strong" here, of the third portion of the stripped end section is characteristic of the punching of the third zone of the tubular portion on this third portion, which is carried out with predetermined punching parameters, and of compacting (stronger than with crimping) of the material of the tubular portion forming this third zone together with the material of the electric cable forming the third portion. In other words, the third portion of the stripped end section is compacted with the third zone of the tubular portion so as to ensure permanent electrical contact between the connecting device and the electric cable.

The assembly according to the invention therefore has mechanical and electrical fastening with particularly good performance between the connecting device and the electric cable thanks to double crimping, providing two different predetermined degrees of compression, away from and near the insertion opening respectively, combined with punching, carried out between the two crimped zones and portions, and providing a predetermined degree of compression higher than the two degrees of compression resulting from crimping.

It should also be noted that the crimping and/or punching parameters are in particular defined by a closing dimension of crimping and/or punching devices and by the shape of impression of said devices. These are the parameters that characterize the degrees of compression obtained, also called degree of reduction of cross-section. These parameters also depend of course on the diameter of the conductive core of the electric cable.

It should be noted that the assembly according to the invention offers particularly good performance while remaining particularly simple, convenient and economical.

According to preferred simple, convenient and economical features of the assembly according to the invention:

said first predetermined degree of compression is comprised in the range [10%; 30%];

said second predetermined degree of compression is comprised in the range [2%; 20%];

said third predetermined degree of compression is comprised in the range [25%; 45%];

said first zone of said tubular portion and said first portion of said stripped end section and/or said second zone of said tubular portion and said second portion of said stripped end section have a B-shape in cross-section;

said first zone of said tubular portion and said first portion of said stripped end section and/or said second zone of said tubular portion and said second portion of said stripped end section have a hexagonal shape in cross-section;

said third zone of said tubular portion and said third portion of said stripped end section have a crescent shape in cross-section;

said electric cable has an aluminium conductive core; and/or said connecting device comprises a sleeve, arranged in said tubular portion, and into which said stripped end section is introduced, said sleeve having a plurality of perforations and being made of a material harder than aluminium so that said sleeve deforms said stripped end section, with said aluminium conductive core being embedded in said perforations of said sleeve.

This disclosure of the invention will now be continued with the description of a practical example, given below by way of illustration and non-limitative, referring to the attached drawings in which.

Figure 1:
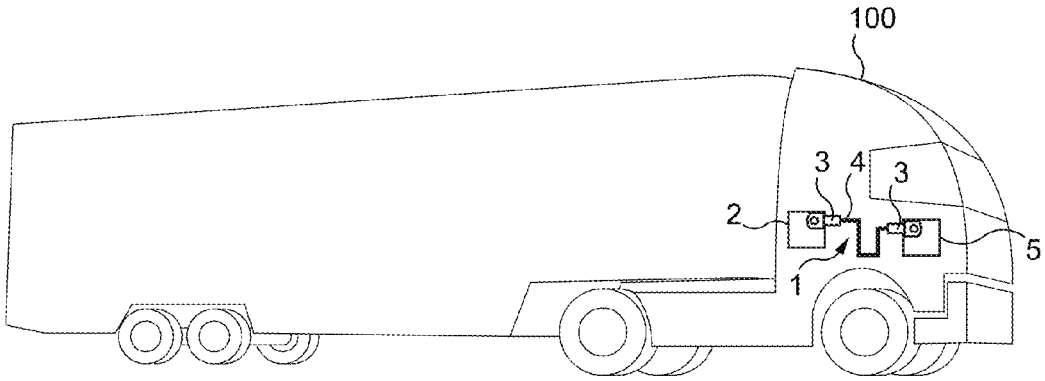
FIG. 1 shows diagrammatically a starter of a vehicle, in this instance a vehicle of the heavy goods type, connected to a battery of this vehicle via at least one assembly according to the invention.

FIG. 1 shows diagrammatically a motor vehicle 100 of the heavy goods type, having a starter 5 configured for turning a ring gear of a heat engine (not shown) of the vehicle 100, said starter 5 being formed by a rotating electric motor connected to a battery 2 via an electrical connecting assembly 1.

The electrical connecting assembly 1 is provided here with two connecting terminals 3 and an electric cable 4 with conductive core 35 of aluminium (FIG. 7) on which the two connecting terminals 3 are securely assembled.

Figure 8:
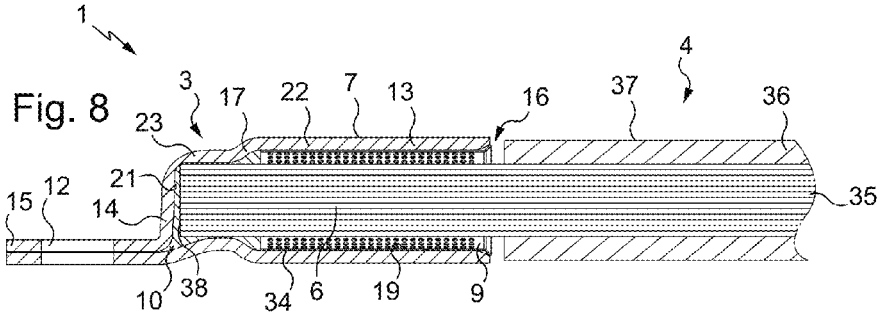
FIG. 8 is a sectional view of the terminal shown in FIG. 7, with the stripped end section introduced into the terminal.

The conductive core 35 comprises in this instance a plurality of aluminium strands (FIG. 8).

The cable 4 has two opposite ends each forming a stripped end section 6 (FIG. 7) where the terminals 3 are crimped and punched.

Figure 2:
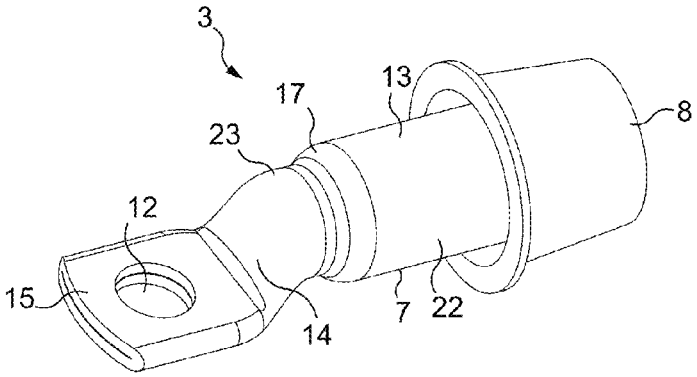
FIG. 2 is an isolated perspective view of a connecting terminal according to the invention, as received in a workshop for assembling the assembly shown in FIG. 1, the connecting terminal then being equipped with a protective cap.
Figure 3:
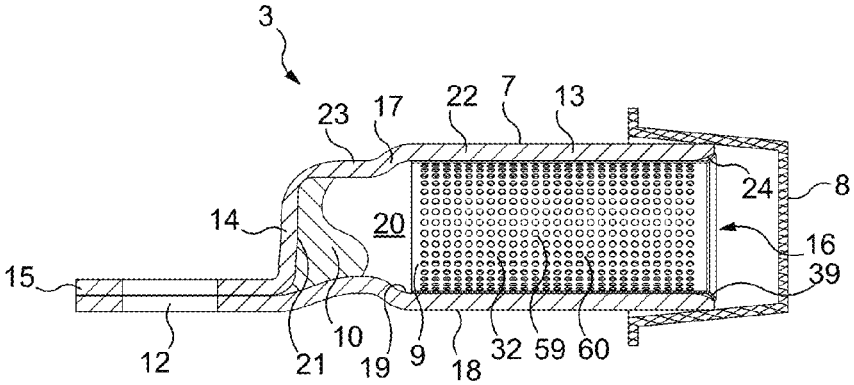
FIG. 3 is a median-section view of the terminal in FIG. 2.

The terminal 3 will be described in detail referring to FIGS. 2 and 3, where a protective cap 8 is mounted on this terminal 3.

Terminal 3 comprises a metal conducting element 7 and a metal tubular monobloc insert 9.

The conducting element 7 comprises a tubular portion 13 extending in a longitudinal general direction, a flat portion 15 connected to the tubular portion 13 by a transitional portion 14 and an insertion opening 16 opposite the transitional portion 14.

The tubular portion 13 is hollow and is provided with an outer face 18 and an inner face 19, which delimits an internal space 20 of the tubular portion 13.

The tubular portion 13 further comprises a first tubular section 22 having a large inside diameter, also called second inside diameter, a second tubular section 23 having a small inside diameter, also called first inside diameter, which is less than the second inside diameter, and an annular shoulder 17 joining the first tubular section 22 to the second tubular section 23.

The first tubular section 22 is located between the annular shoulder 17 and the insertion opening 16.

The second tubular section 23 is located between the annular shoulder 17 and the transitional portion 14.

The second tubular section 23 has in this instance a length less than the first inside diameter and the first tubular section 22 has in this instance a length greater than the second inside diameter.

The tubular portion 13 comprises an insertion chamfer 24 provided on the first tubular section 22, at the level of the insertion opening 16.

The transitional portion 14 joins the second tubular section 23 of the tubular portion 13 to the flat portion 15.

This transitional portion 14 forms a bottom wall of the tubular portion 13, said bottom wall having an inner face 21 oriented towards the internal space 20.

The bottom wall is in this instance straight, substantially perpendicular to the longitudinal general direction of the tubular portion 13 and substantially perpendicular to the flat portion 15.

The flat portion 15 forms an area for mechanical and electrical contact configured for interacting with a predetermined electrical terminal (not shown).

This predetermined electrical terminal belongs in this instance either to the battery 2 or to the starter 5.

The flat portion 15 has a parallelepipedal overall shape, has a predetermined width, and is provided with a hole 12 made centrally and configured to receive a fixing device (not shown), for example a bolt having a screw and a nut.

It should be noted that this bolt belongs in one case to the battery 2 and in the other case to the starter 5.

The tubular monobloc insert 9 comprises a sleeve 32 and a flared ring 39 located at one end of the sleeve 32.

The sleeve 32 is located in the internal space 20 of the tubular portion 13, at the level of the first tubular section 22.

Figure 6:
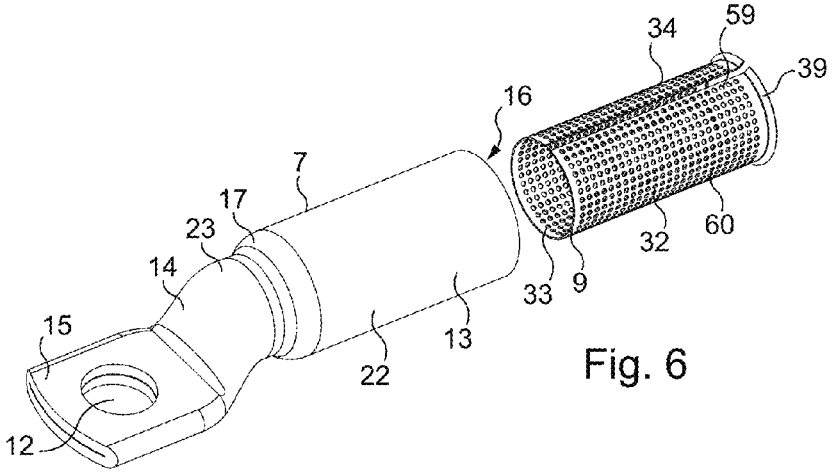
FIG. 6 is a partial exploded perspective view of the terminal shown in FIGS. 2 and 3, showing a conducting element and a perforated sleeve.

The sleeve 32 comprises a split body 60 having a cylindrical overall shape (FIG. 6).

The body 60 has an outside diameter (when this body 60 is not subjected to any stress) substantially similar to, or even slightly greater than, the second inside diameter of the first tubular section 22 of the tubular portion 13 (FIG. 6).

The body 60 comprises an inner face 33 and an outer face 34, which makes contact with the inner face 19 of the tubular portion 13.

The body 60 is mounted slightly compressed in the internal space 20 of the tubular portion 13 (thanks to the slit).

Furthermore, sleeve 32 has a plurality of perforations 59 made in the body 60.

It should be noted that this sleeve 32 is configured to deform the stripped end section 6, with the aluminium conductive core 35 (FIG. 7) of the cable 4, which is embedded in these perforations 59 (see below).

The flared ring 39 is located at the end of the sleeve 32 in close proximity to the insertion opening 16 and therefore of the insertion chamfer 24.

The flared ring 39 has a profile similar to that of the insertion chamfer 24, on which this flared ring 39 is seated.

It should be noted that the flared ring 39 delimits the insertion opening 16 of the conducting element 7.

It should further be noted that the flared ring 39 is configured to facilitate introduction of the stripped end section 6 of the cable 4 into the internal space 20 of the tubular portion 13.

A predetermined quantity of contact grease 10 is introduced into the internal space 20 of the tubular portion 13, at the level of and opposite the bottom wall of the latter.

This contact grease 10 is configured to improve the electrical conductivity between the aluminium conductive core 35 (FIG. 7) of the cable 4, the insert 9 and the conducting element 7.

The cap 8 is mounted on the outer face 18 of the tubular portion 13, at the level of the first tubular section 22 and opposite the insertion opening 16, so as to block the internal space 20 of the tubular portion 13.

Figure 4:
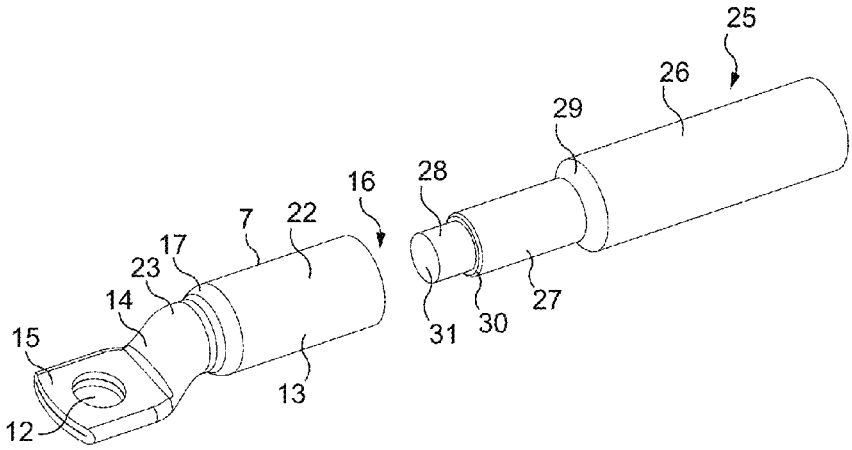
FIG. 4 is a perspective view of the terminal shown in FIGS. 2 and 3 and of a deforming mandrel that served for shaping a bottom wall of this terminal.

The method of manufacture of the terminal 3 will now be described, referring to FIGS. 4 to 6.

The conducting element 7 is manufactured from an initial cylindrical metal tube having a predetermined inside diameter corresponding to the first inside diameter of the second tubular section 23 of the tubular portion 13.

Two opposite walls of the cylindrical tube are flattened (brought closer together until they are in contact) at one end opposite to the insertion opening 16 so as to form the flat portion 15. This flattening creates a first configuration of the transitional portion 14 (inclined orientation of the bottom wall) and thus closes the internal space 20 of the side opposite the insertion opening 16.

Then, the tubular portion 13 is formed by expansion over a predetermined length in order to form the first tubular section 22 having the second inside diameter, and the annular shoulder 17 (on the inner face 19), said shoulder thus delimiting the first and second sections 22 and 23 of the tubular portion 13.

Then the transitional portion 14 is deformed so that the bottom wall of the tubular portion 13 is straightened up from the inclined orientation that it had at the end of the flattening step to the straight orientation shown in the drawings.

These deformations are performed with a deforming mandrel 25 (FIGS. 4 and 5), in this instance an expanding mandrel, configured to be introduced into the internal space 20 of the tubular portion 13 via its insertion opening 16.

These deformations are moreover carried out with a die (not shown) configured so that the tubular portion 13 is sandwiched between said die and the expanding mandrel 25. The die is therefore applied on the outer face 18 of the tubular portion 13.

This expanding mandrel 25 comprises a body provided with a first cylindrical part 26 having a first outside diameter greater than the second inside diameter of the first tubular section 22, a second cylindrical part 27 having a second outside diameter similar (within the clearance for insertion) to the second inside diameter of the first tubular section 22 and a third cylindrical part 28 having a third outside diameter similar (within the clearance for insertion) to the first inside diameter of the second tubular section 23.

The first cylindrical part 26 is joined to the second cylindrical part 27 by a first annular shoulder 29 and the third cylindrical part 28 is joined to the second cylindrical part 27 by a second annular shoulder 30.

The third cylindrical part 28 comprises at its end that is on the side opposite to the side joined to the second shoulder 30, a face 31, which is flat.

It should be noted that the second cylindrical part 27 together with the first annular shoulder 29 have substantially the same length as the length of the tubular insert 9.

It should further be noted that the second shoulder 30 is configured in order to form, together with the die, the shoulder 17 of the tubular portion 13.

It should also be noted that the flat face 31 is configured in order to form the inner face 21 of the bottom wall of the tubular portion 13.

The step of deformation by expansion with the mandrel 25 is carried out by inserting said mandrel 25 with the second cylindrical part 27 that makes contact with the inner face 19 at the level of its first tubular section 22 for expanding the latter, with the shoulder 29 that comes in contact with the inner face 19 in proximity to the insertion opening 16 in order to create the insertion chamfer 24, with the shoulder 30, which will form the shoulder 17, and with the flat face 31 which comes against the transitional portion 14 to straighten it and thus form the straight bottom wall and therefore the inner face 21.

The conducting element 7 is therefore mainly formed by deformation and expansion of the initial cylindrical tube by the expanding mandrel 25 and the die (not shown).

Figure 5:
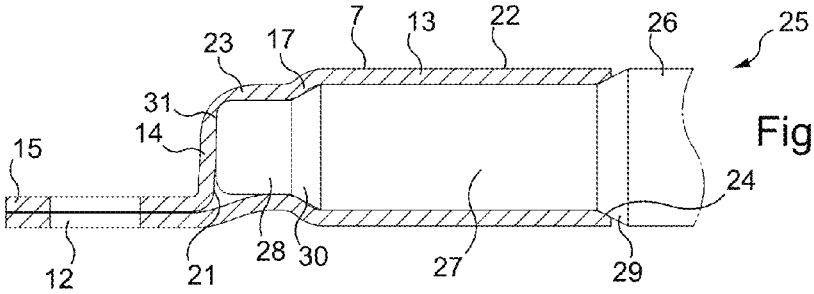
FIG. 5 is a sectional view of the terminal shown in FIGS. 2 and 3, after expansion of the bottom wall, with the deforming mandrel still introduced in said terminal.

It should be noted that the expanding mandrel 25 leaves, on the bottom wall 21, a flat zone, generally with a length at least equal to one third of the diameter of the bottom wall 21 (see the part of the face 31 in contact with the bottom wall 21 in FIG. 5).

It will be recalled that it is considered in this instance that the bottom wall 21 extends substantially perpendicularly to the longitudinal direction of the tubular portion 13 since a flat zone of a length at least equal to one third of the diameter of the bottom wall 21 has an angle, relative to the longitudinal direction of the tubular portion 13, comprised within the range [80°; 100°].

The tubular monobloc insert 9 (provided with the sleeve 32 and the flared ring 39) is then supplied and introduced into the internal space 20 of the tubular portion 13 via the insertion opening 16.

It should be noted that introduction of this insert 9 is facilitated by the insertion chamfer 24.

The insert 9 is introduced until it comes up against the annular shoulder 17, and with the flared ring 39 which is seated in the insertion chamfer 24.

The inner face 19 of the tubular portion 13 is opposite to the outer face 34 of the sleeve 32.

A predetermined quantity of contact grease 10 is introduced into the internal space 20 against the inner face 21.

Figure 7:
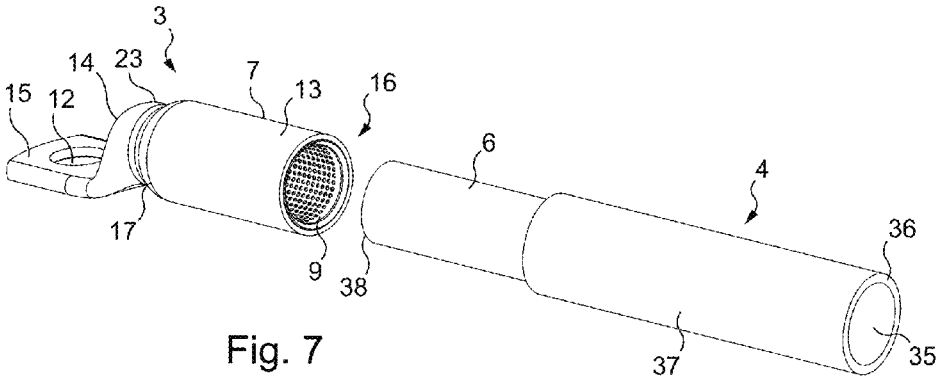
FIG. 7 is a partial perspective view of the terminal shown in FIGS. 2 and 3, and of an electric cable at a distance from the terminal and provided with a stripped end section.

As can be seen in FIG. 7, the electric cable 4 comprises, in addition to the conductive core 35 provided with a plurality of aluminium strands, an insulating sheath 36 with a predetermined thickness enveloping said conductive core 35.

The electric cable 4 comprises an insulated section 37, provided with the conductive core 35 and the sheath 36, and a stripped end section 6 located at the end of the insulated section 37, said stripped end section 6 lacking the sheath 36.

The stripped end section 6 has an approximately flat end face 38 opposite the insulated section 37.

The assembly 1 comprising the terminal 3 assembled integrally with the stripped end section 6 of the electric cable 4 will now be described in detail, referring to FIGS. 11 to 15.

The tubular portion 13 has, along what was initially its first tubular section 22 located between the insertion opening 16 and the annular shoulder 17, a first crimped zone 40, a second crimped zone 41 and a third punched zone 42.

The first zone 40 is farthest from the insertion opening 16 whereas the second zone 41 is closest to it. As for the third zone 42, it is located between the first zone 40 and the second zone 41.

The stripped end section 6 has a first portion 43 at a distance from the insertion opening 16, a second portion 44 close to this insertion opening 16 as well as a third portion 56 located between the first portion 43 and the second portion 44.

The first zone 40 is crimped on the first portion 43, which has a first degree of compression, also called degree of reduction of cross-section (DRCS).

This first degree of compression is in this instance within the range [10%; 30%]. It should be noted that in this instance it is an average degree of compression.

It should also be noted that the degrees of compression (or degrees of reduction of cross-section) are in this instance calculated from the following relation:

$$DRCS(\%) = \left(1 - \frac{B}{A}\right) \times 100;$$

with:

A: sum of the cross-sections of the strands of the conductive core 35, before crimping and/or punching, in $mm^2$; and B: sum of the cross-sections of the strands of the conductive core 35, after crimping and/or punching, in $mm^2$ (excluding the spaces created between the crimped and punched strands).

Figure 13:
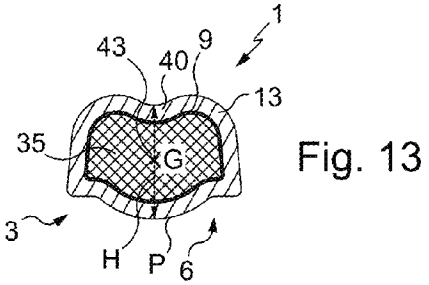
FIG. 13 is a sectional view marked XIII-XIII in FIG. 12, showing a first zone of the terminal crimped on a first portion of the stripped end section of the electric cable.

As illustrated in FIG. 13, the first zone 40 and the first portion 43 have, in cross-section, a general B-shape.

It should be noted that the compactness of the assembly formed from the first crimped zone 40 and portion 43 has in this instance a ratio of external perimeter P of said zone and portion to the smallest height H passing through the centre of gravity G (in this instance the geometric centre) of said zone and portion that is less than about 6, indicative of a first crimping.

In this instance it is considered that when a zone or portion has said ratio less than 6, it is a question of crimping.

The second zone 41 is crimped on the second portion 44, which has a second degree of compression that is less than the first degree of compression.

This second degree of compression is in this instance comprised within the range [2%; 20%]. It should be noted that in this instance it is a low degree of compression.

Figure 14:
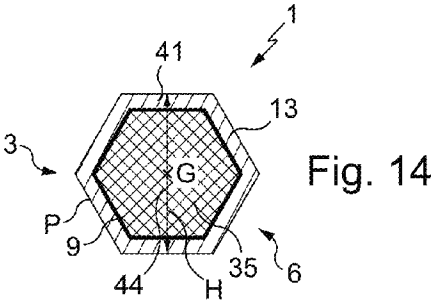
FIG. 14 is a sectional view marked XIV-XIV in FIG. 12, showing a second zone of the terminal crimped on a second portion of the stripped end section of the electric cable.

As illustrated in FIG. 14, the second zone 41 and the second portion 44 have a hexagonal shape in cross-section.

It should be noted that the compactness of the assembly formed from the second crimped zone 41 and portion 44 has in this instance a ratio of external perimeter P of said zone and portion to the smallest height H passing through the centre of gravity G (in this instance the geometric centre) of said zone and portion that is less than about 6, indicative of a second crimping.

The third zone 42 is punched with the third portion 56, which has a third degree of compression that is higher than the first and second degree of compression.

This third degree of compression is in this instance comprised within the range [25%; 45%]. It should be noted that in this instance it is a high degree of compression.

Figure 15:
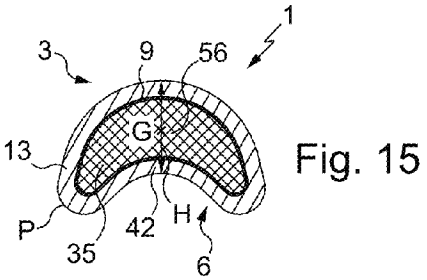
FIG. 15 is a sectional view marked XV-XV in FIG. 12, showing a third zone of the terminal punched on a third portion of the stripped end section of the electric cable.
Figure 11:
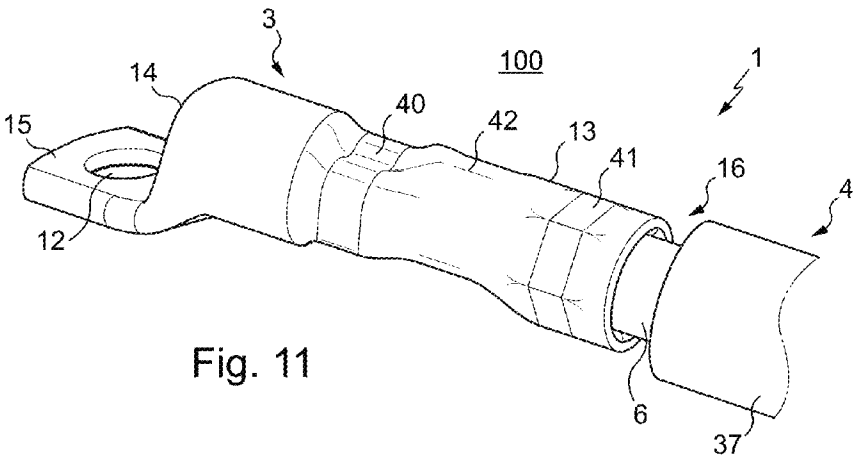
FIG. 11 is a partial perspective view of the assembly shown in FIG. 1.
Figure 12:
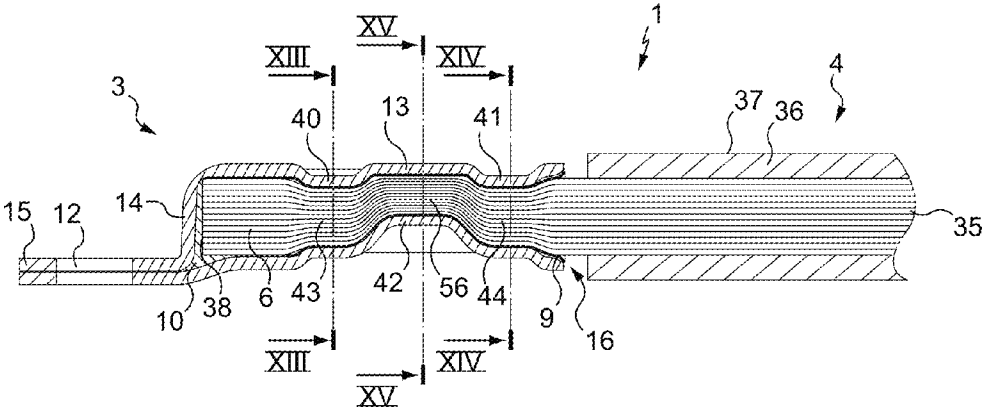
FIG. 12 is a partial sectional view of the assembly shown in FIG. 11.

As illustrated in FIG. 15, the third punched zone 42 and the third portion 56 have a crescent shape in cross-section.

It should be noted that the compactness of the assembly formed from the third punched zone 42 and portion 56 has in this instance a ratio of external perimeter P of said zone and portion to the smallest height H passing through the centre of gravity G (in this instance the geometric centre) of said zone and portion that is greater than about 6, indicative of punching.

It is considered in this instance that when a zone or portion has such a ratio greater than or equal to 6, it is a question of punching.

Figure 9:
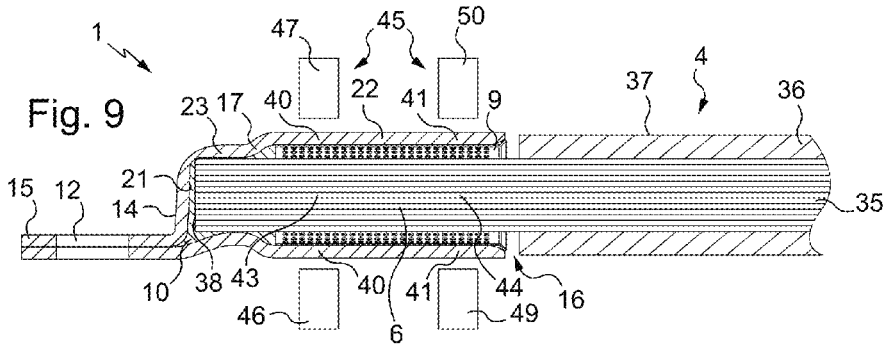
FIG. 9 is a view similar to FIG. 8, but showing diagrammatically a crimping device configured for crimping several zones of the terminal on several portions of the stripped end section of the electric cable.
Figure 10:
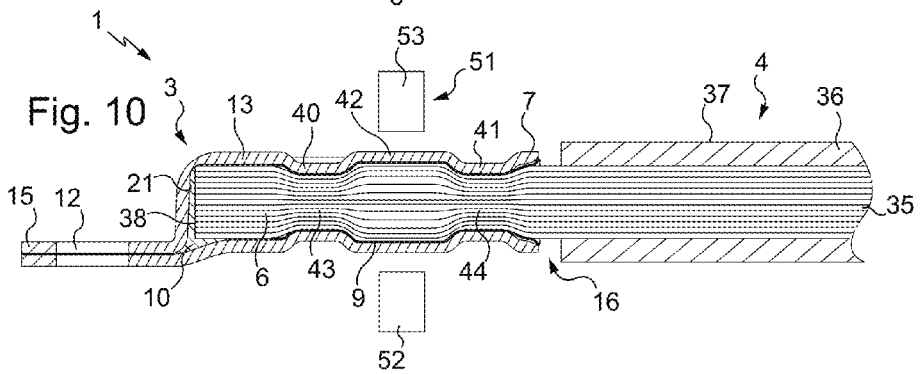
FIG. 10 is a view similar to FIG. 8, but showing diagrammatically a punching device configured for punching a zone of the terminal on a portion of the stripped end section of the electric cable, in order to form the assembly shown in FIG. 1.

The method of securely assembly of assembly 1 will now be described, referring to FIGS. 8 to 10.

Only the stripped end section 6 of the cable 4 is introduced via the insertion opening 16 into the terminal 3, the insulated section 37 being opposite this insertion opening 16.

It should be noted that introduction of this stripped end section 6 into the terminal 3 is facilitated by the flared ring 39.

The stripped end section 6 is introduced into the terminal 3 until the end face 38 of the cable 4 is opposite the inner face 21 of the bottom wall of the tubular portion 13.

A layer of contact grease 10 separates this inner face 21 from the end face 38.

The straight bottom wall of the tubular portion 13 makes it possible, once the end face 38 of the cable 4 is opposite the inner face 21 of said tubular portion 13, to return, with good distribution, a portion of the contact grease 10 around the first, second and third portions 43, 44 and 56 of the stripped end section 6.

The conductive core 35 has a diameter substantially equal to the first inside diameter of the second tubular section 23, which makes it possible to guide the stripped end section 6 in the internal space 20.

The first zone 40 and the second zone 41 of the first tubular section 22 of the tubular portion 13 are crimped in a single step respectively on the first and second portions 43 and 44 of the stripped end section 6, by a single crimping device 45 configured to obtain different degrees of compression of the crimped strands of the stripped end section 6.

This crimping device 45 comprises a first lower jaw 46, a first upper jaw 47 opposite the first lower jaw 46, a second lower jaw 49 different from the first lower jaw 46 and a second upper jaw 50 different from the first upper jaw 47 and opposite the second lower jaw 49.

The first lower jaw 46 and the first upper jaw 47 form a first pair of crimping jaws 46, 47, whereas the second lower jaw 49 and the second upper jaw 50 form a second pair of crimping jaws 49, 50.

The first pair of crimping jaws 46, 47 has a B-shaped impression and is arranged directly above the outer face 18 of the tubular portion 13, with the B-shaped impression opposite the first tubular section 22, close to the shoulder 17 (in other words at a distance from the insertion opening 16).

This first pair of crimping jaws 46, 47 is configured for crimping the first zone 40 of the tubular portion 13 on the first portion 43 of the stripped end section 6 according to first predetermined crimping parameters so as to provide the first portion 43 with first predetermined degree of compression, and to provide the first zone 40 and portion 43 with a B-shape in cross-section.

The second pair of crimping jaws 49, 50 has a hexagon-shaped impression and is arranged directly above and below the outer face 18 of the tubular portion 13, with the hexagon-shaped impression opposite the first tubular section 22, close to the insertion opening 16 (in other words at a distance from the shoulder 17).

This second pair of crimping jaws 49, 50 is configured for crimping the second zone 41 of the tubular portion 13 on the second portion 44 of the stripped end section 6 according to second predetermined crimping parameters so as to provide the second portion 44 with a second predetermined degree of compression (less than the first degree of compression), and to provide the second zone 41 and portion 44 with a hexagonal shape in cross-section.

The third zone 42 of the first tubular section 22 of the tubular portion 13 is then punched with the third portion 56 of the stripped end section 6, by a punching device 51 configured to obtain a high degree of compression of the punched strands of the stripped end section 6.

This punching device 51 comprises a punch 52 and a punch die 53 opposite the punch 52.

The punch 52 and the die 53 have a punching impression of crescent shape and are arranged directly above and below the outer face 18 of the tubular portion 13, with the crescent-shaped impression opposite the first tubular section 22, between its first and second zones 40 and 41.

Said punch 52 and said die 53 are configured for punching the third zone 42 of the tubular portion 13 on the third portion 56 of the stripped end section 6 according to predetermined punching parameters so as to provide a third portion 56 with a third predetermined degree of compression (higher than the first and second degree of compression), and to provide the third zone 42 and portion 56 with a crescent shape in cross-section.

It should be noted that the sleeve 32 is crushed by the crimping and punching steps on the stripped end section 6, which is thus deformed and the conductive core 35 is incrusted in the perforations 59 of the sleeve 32.

It should be noted that these crimping and/or punching parameters are in particular defined by the closing dimension of the crimping and/or punching devices 45 and 51 and by the shape of the impressions of the latter. These parameters also depend of course on the diameter of the conductive core 35 of the electric cable 4.

As a variant, this step of deformation of the transitional portion is not implemented; and the invention relates to a method of manufacture of a connecting device to be crimped on a stripped end section of electric cable, comprising the step of supplying a conducting element produced in a single piece and having a tubular portion, an insertion opening through which it is intended to introduce said stripped end section into said tubular portion and a flat portion configured for cooperating with a predetermined electrical terminal, said tubular portion being joined, at an end opposite said insertion opening, via a transitional portion, to said flat portion; said method comprising the step of supplying a cylindrical conducting tube having a first predetermined inside diameter and which comprises said insertion opening, and the step of expanding, at least partially, said cylindrical conducting tube to form said tubular portion, which is provided with at least one first tubular section having a second inside diameter greater than said first predetermined inside diameter.

In variants that are not shown:

- the first zone and the second zone of the first tubular section of the tubular portion are crimped respectively on the first and second portions of the stripped end section, in two successive steps rather than in a single step, by a single crimping device or two separate crimping devices;
- the two crimping operations and the punching operation are carried out by a same device at the same time or successively;
- the first zone and the second zone of the first tubular section of the tubular portion are crimped on the first and second portions of the stripped end section and the crimped assemblies have, respectively, a hexagonal shape and a B-shape in cross-section;
- the first zone and the second zone of the first tubular section of the tubular portion are crimped on the first and second portions of the stripped end section and the crimped assemblies both have a B-shape or a hexagonal shape in cross-section;
- the third zone is punched with the third portion of the stripped end section and the punched assembly has, in cross-section, a shape different from a crescent, for example a star shape or an H-shape;
- the insert is introduced into the tubular portion of the terminal at the same time as the manufacture of the latter, with the flared ring that is already formed or only pre-formed, and, if necessary, the flared ring is finish-formed against the insertion chamfer, by the expanding mandrel;
- the connecting device formed by the connecting terminal is replaced with another connecting device, for example a connecting joint provided with two tubular portions separated by a flat portion; and/or
- the conductive core of the electric cable is of copper rather than of aluminium, and the connecting device does not have an insert.

The method that has just been described comprises a step of deformation of the transitional portion until said transitional portion forms an approximately straight bottom wall of the tubular portion, where said bottom wall extends substantially perpendicularly to the longitudinal general direction of the tubular portion.

It should be noted more generally that the invention is not limited to the examples that have been described and illustrated.

The invention claimed is:

1. An assembly comprising a connecting device (3) securely assembled on a stripped end section (6) of an electric cable (4), said connecting device (3) comprising a conducting element (7) having a tubular portion (13) and an insertion opening (16) through which said stripped end section (6) is introduced into said tubular portion (13), said assembly (1) being wherein said tubular portion (13) comprises a first crimped zone (40) with a first portion (43) of said stripped end section (6) that is located in said first zone (40), said first zone (40) being farthest from said insertion opening (16), and with said first portion (43) having a first predetermined degree of compression; said tubular portion (13) further comprises a second crimped zone (41) with a second portion (44) of said stripped end section (6) that is located in said second zone (41), said second zone (41) being closest to said insertion opening (16), and with said second portion (44) having a second predetermined degree of compression lower than said first predetermined degree of compression; and said tubular portion (13) further comprises a third punched zone (42) with a third portion (56) of said stripped end section (6) that is located in said third zone (42), said third zone (42) being between said first and second zones (40, 41), and with said third portion (56) that has a third predetermined degree of compression higher than said first predetermined degree of compression; thanks to which said tubular portion (13) and said stripped end section (6) are crimped and punched together.

2. The assembly according to claim 1, wherein said first predetermined degree of compression is comprised in a range of 10% to 30%.

3. The assembly according to claim 1, wherein said second predetermined degree of compression is comprised in a range of 2% to 20%.

4. The assembly according to claim 1, wherein said third predetermined degree of compression is comprised in a range of 25% to 45%.

5. The assembly according to claim 1, wherein said first zone (40) of said tubular portion (13) and said first portion (43) of said stripped end section (6) and/or said second zone (41) of said tubular portion (13) and said second portion (44) of said stripped end section (6) have a B-shape in cross-section.

6. The assembly according to claim 1, wherein said first zone (40) of said tubular portion (13) and said first portion (43) of said stripped end section (6) and/or said second zone (41) of said tubular portion (13) and said second portion (44) of said stripped end section (6) have a hexagonal shape in cross-section.

7. The assembly according to claim 1, wherein said third zone (42) of said tubular portion (13) and said third portion (56) of said stripped end section (6) have a crescent shape in cross-section.

8. The assembly according to claim 1, wherein said electric cable (4) comprises an aluminium conductive core (35).

9. The assembly according to claim 8, wherein said connecting device (3) comprises a sleeve (32) arranged in said tubular portion (13) and into which said stripped end section (6) is introduced, said sleeve (32) having a plurality of perforations (59) and being made of a material harder than aluminium so that said sleeve (32) deforms said stripped end section (6), with said aluminium conductive core (35) being embedded in said perforations (59) of said sleeve (32).

10. An assembly comprising:

a stripped end section (6) of an electric cable (4); and a connecting device (3) securely assembled on the stripped end section (6) of the electric cable (4), said connecting device (3) comprising a conducting element (7) having a tubular portion (13) and an insertion opening (16), said stripped end section (6) of the electric cable (4) extending through the insertion opening (16) and into an interior of the tubular portion (13), wherein said tubular portion (13) comprises a) a crimped first zone (40) with a first portion (43) of said stripped end section (6) located in said crimped first zone (40), and with said first portion (43) having a first predetermined degree of compression, b) a crimped second zone (41) with a second portion (44) of said stripped end section (6) located in said crimped second zone (41), and with said second portion (44) having a second predetermined degree of compression lower than said first predetermined degree of compression, wherein, of said crimped first zone and said crimped second zone, said crimped first zone (40) is farthest from said insertion opening (16) and said crimped second zone (41) is closest to said insertion opening (16), and c) a punched third zone (42) with a third portion (56) of said stripped end section (6) that is located in said punched third zone (42), said punched third zone (42) being located between said crimped first and second zones (40, 41), and with said third portion (56) having a third predetermined degree of compression higher than said first predetermined degree of compression, whereby said tubular portion (13) and said stripped end section (6) are crimped and punched together, and wherein said first predetermined degree of compression is comprised in a range of 10% to 30%, wherein said second predetermined degree of compression is comprised in a range of 2% to 20%, and wherein said third predetermined degree of compression is comprised in a range of 25% to 45%, wherein a compactness of the third punched zone defined as a ratio of i) an external perimeter of the third punched zone to ii) a smallest height passing through a center of gravity of the third punched zone, is greater than 6, and wherein a compactness of the crimped first zone and of the crimped second zone defined as i) a ratio of external perimeter of the crimped first zone and of the crimped second zone to ii) a smallest height passing through a center of gravity of the crimped first zone and of the crimped second zone, is less than 6.

11. The assembly according to claim 10, wherein, said first zone (40) of said tubular portion (13) and said first portion (43) of said stripped end section (6) and said second zone (41) of said tubular portion (13) and said second portion (44) of said stripped end section (6) each have a shape of one of the group consisting of i) a B-shape in cross-section and ii) a hexagonal shape in cross-section, said third zone (42) of said tubular portion (13) and said third portion (56) of said stripped end section (6) have a crescent shape in cross-section, said electric cable (4) comprises an aluminium conductive core (35), and said connecting device (3) further comprises a sleeve (32) arranged in the interior of the tubular portion (13), said stripped end section (6) of the electric cable (4) extending into an interior of the sleeve (32), said sleeve (32) having a plurality of perforations (59) and being made of a material harder than aluminium, said sleeve (32) deforming said stripped end section (6), with said aluminium conductive core (35) being embedded in said perforations (59) of said sleeve (32).

12. The assembly according to claim 11, wherein said connecting device (3) further comprises a sleeve (32) arranged in the interior of the tubular portion (13), said stripped end section (6) of the electric cable (4) extending into an interior of the sleeve (32), said sleeve (32) having a plurality of perforations (59) and being made of a material harder than aluminium, said sleeve (32) deforming said stripped end section (6), with said aluminium conductive core (35) being embedded in said perforations (59) of said sleeve (32).

* * * * *